United States Patent [19]

Ramer

[11] 4,431,890

[45] Feb. 14, 1984

[54] INDUCTION HEATED STEAM FLASH PLUG

[76] Inventor: James L. Ramer, Rt. 1, Box 382, Whitestown, Ind. 46075

[21] Appl. No.: 218,908

[22] Filed: Dec. 22, 1980

[51] Int. Cl.[3] ..... H05B 6/10

[52] U.S. Cl. ..... 219/10.51; 219/10.57; 219/10.47; 60/513; 60/659

[58] Field of Search ..... 219/10.51, 10.49 R, 219/10.57, 10.65, 10.75, 10.73, 10.79, 10.47; 60/659, 682, 508, 513, 523; 123/549

[56] References Cited

U.S. PATENT DOCUMENTS

| | | | |
|---|---|---|---|
| 1,290,966 | 1/1919 | Garland . | |
| 1,362,622 | 12/1920 | Hendricks, Jr. | 219/10.51 |
| 1,744,288 | 1/1930 | Vorel . | |
| 2,226,447 | 12/1940 | Smith et al. | 219/10.51 |
| 2,411,409 | 11/1946 | Ballard | 219/10.51 |
| 2,441,312 | 5/1948 | Dickerson et al. | 219/10.51 X |
| 2,563,883 | 8/1951 | Strickland, Jr. | 219/10.51 |
| 2,622,184 | 12/1952 | Johneas | 219/10.51 X |
| 2,644,881 | 7/1953 | Schörg | 219/10.51 |
| 3,400,534 | 9/1968 | Michelson . | |
| 3,494,724 | 2/1970 | Gray | 219/10.55 X |
| 3,990,238 | 11/1976 | Bailey . | |
| 4,089,176 | 5/1978 | Ashe | 219/10.51 X |

*Primary Examiner*—B. A. Reynolds
*Assistant Examiner*—Philip H. Leung
*Attorney, Agent, or Firm*—Darrell E. Hollis

[57] ABSTRACT

A flash plug for an internal expansion heat engine is heated by a non-ferrous coil surrounding the ferric steam flash plug and connected to a source of alternating current. The coil may be a conduit for the passage of cooling water.

12 Claims, 3 Drawing Figures

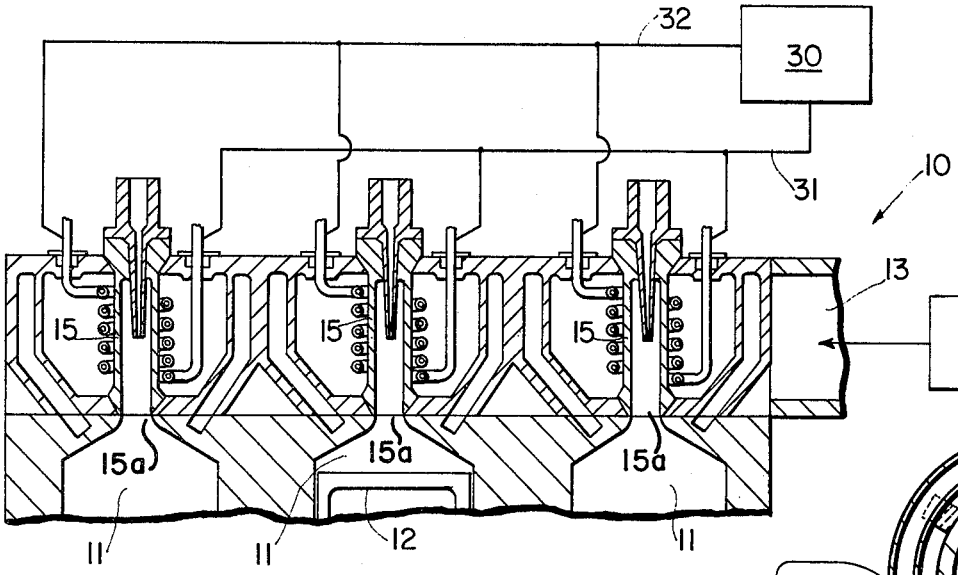
FIG. 1
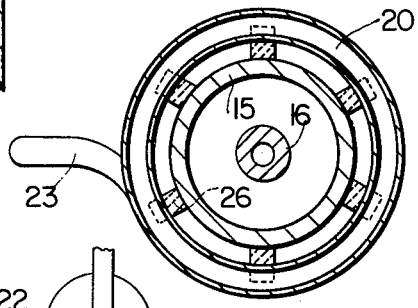
FIG. 3
FIG. 2
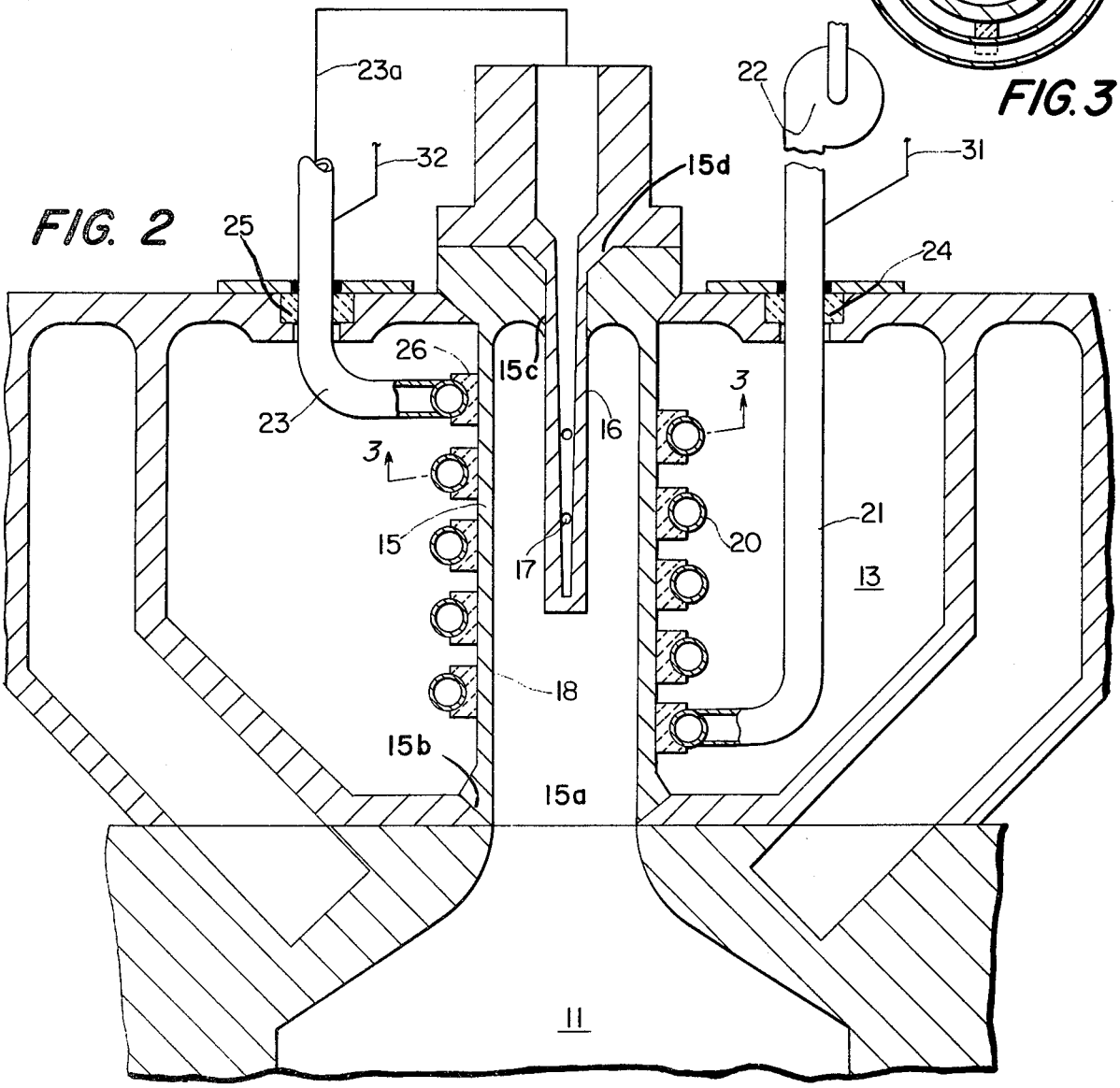

INDUCTION HEATED STEAM FLASH PLUG

BACKGROUND OF THE INVENTION

The present invention relates to an internal expansion heat engine, and more particularly to a flash plug for such an engine.

Internal expansion heat engines are known, and are of either the piston type or the vane type, which pistons of vanes are provided as movable elements within an expansion chamber or chambers. Steam is applied to the expansion chamber or chambers, in order to move the movable elements to cause a shaft to rotate.

To supply steam to the expansion chamber or chambers, steam plugs may be utilized, which are of hollow construction, and which are heated from the outside, and are provided with a spray of water on the inside, the water particles which are sprayed engaging the interior surface of the hollow steam plug, and being convereted thereby to steam. The hollow steam plug is connected to the expansion chamber or chambers, and thereby provides steam thereto. The steam plugs are heated by being placed in a fire chamber, where they are exposed to heated gasses and/or flames, which may be generated by a suitable burner, such as an oil burner or a burner for pulverized coal. The hot gasses of combustion are conducted through the fire chamber, where they engage and heat the steam plugs.

A number of proposals in connection with such internal expansion engines have been made. Bailey U.S. Pat. No. 3,990,238 discloses an engine of this type which is provided with a "steam head" which comprises a plurality of heat plates which are in spaced apart relationship, passages between the plates defining steam passages which lead to the expansion chamber of the engine. The plates themselves are heated by electrical resistance coils. Vorel U.S. Pat. No. 1,744,288 discloses a steam engine of the piston type wherein water is supplied through a pipe, and is converted to steam, which is conducted to the pistons, heating of the water being effected by electrical resistance coils. Garland U.S. Pat. No. 1,290,966 is a disclosure of a steam engine in which the piston is provided with electric resistance coils, to cause water sprayed into the cylinder in which the piston moves to be heated into steam. Of general interest is Michelson U.S. Pat. No. 3,400,534 which provides the disclosure of a steam engine which includes spark discharge chambers in which high voltage sparks are discharged between spaced electrodes to heat the water and produce a shock wave. In general, these prior art proposals have been deficient in not providing a satisfactory heated steam generator, and in utilizing no electric heating, or utilizing only electric heating from resistance heaters or spark discharge.

SUMMARY OF THE INVENTION

This invention is directed to an improvement in internal expansion heat engines, and more particularly to the generation of heat for the flash plugs of the engine. The flash plugs are, preferably, heated by combustion gasses, such as from a suitable burner, the flash plugs being hollow and made of ferric material. Water is sprayed on the interior surfaces of the flash plugs, to be converted into steam. Heat is supplied to the flash plug through the medium of induction heating, and this is effected by a coil of non-ferrous material in surrounding relationship to the flash plug, and magnetically coupled thereto, the coil being supplied with alternating current, preferably in the range of 10,000 to 25,000 hertz. The coil is preferably hollow, and is supplied with coolant, such as water, the cooling water preventing harm to the induction heating hollow coil from the heat of its environment, the heated water being usable as the injection water into the steam plug.

BRIEF DESCRIPTION OF THE DRAWING

FIG. 1 is a cross-sectional view, partly schematic, of an engine in accordance with the present invention.

FIG. 2 is an enlarged cross-sectional view, partly schematic showing the steam plug of the present invention.

FIG. 3 is a cross-sectional view taken on the line 3—3 of FIG. 2.

DESCRIPTION OF THE PREFERRED EMBODIMENT

Referring now to the drawings, wherein like or corresponding reference numerals are used to designate like or corresponding parts throughout the several views, there is shown in FIG. 1 an internal expansion engine generally designated 10, and comprising a plurality of expansion chambers 11. A movable element, in the form of a piston 12, is shown in one of the expansion chambers 11, the other expansion chambers 11 also containing pistons, not shown in FIG. 1. As will be understood, expansion heat engines may also be in the form of rotary engines, such as turbines.

Above the expansion chambers 11 is a fire chamber 13, furnished with hot gasses and/or flames from a source 14, which may be a burner. For example, the source 14 may comprise an oil burner or a burner for pulverized coal. The hot gasses thus generated traverse the fire chamber 13.

Extending through the fire chamber 13 are a plurality of hollow flash steam plugs 15.

Referring to FIG. 2, the hollow steam flash plug 15 may be seen, being made of a material which becomes heated when subjected to an alternating electrical field, such as ferrous or ferric metals and nickel. The flash plug 15 has a discharge end **15*a*, surrounding which is an exterior seat 15*b*. Opposite the discharge end 15*a* is an inlet opening 15*c*, surrounding which is a second exterior seat 15*d*. Extending through the opening 15*c*, there is a tubular injector 16 having holes 17 therein, for spraying water onto the interior surface 18 of plug 15**.

A coil 20 of non-ferrous material, preferably of copper or other material of low electric resistance, is in adjacent surrounding relationship to the plug 15, and as will be seen in FIG. 2, the coil 20 is hollow. A conduit 21 is connected to the coil 20, and to a pump 22, so that water is thereby supplied through the conduit 21 to the coil 20. A conduit 23 is connected to the opposite end of the coil 20. Preferably, the conduit 23 is extended, as by extension **23*a* thereof, to the inlet of the injector 16 so that at least part of the water supplied to the injector 16** is heated water.

A annular ceramic insulator 24 is provided in surrounding relationship to the conduit 21, where it enters into the fire chamber 13, and a similar annular insulator 25 is provided about the conduit 23 where it exits the fire chamber 13.

Shown in FIGS. 2 and 3 are a plurality of ceramic insulators 26, which are heat-resistant, and non-electrically conducting, and these support the tube 20 and serve to separate it from the plug 15.

Referring again to FIG. 1, there is schematically shown a generator 30 of alternating current, generator 30 generating alternating current at a frequency, preferably between 10,000 and 25,000 hertz. The alternating generator 30 is connected in conventional manner to the coils 20 by conductors 31 and 32.

In operation, heat is initially supplied to the plugs 15 by heated gasses from the source 14. Water is sprayed by the injector 16 against the interior surface 18 of the plug 15, being thereby converted into steam, which enters into the expansion chambers 11 to drive the movable elements or pistons 12 therein. The plugs 15 are also inductably heated by the coils 20, supplied with alternating current from the generator 30 by way of the conductors 31 and 32. The alternating current supplied to the coils 20 causes an electric field to build and collapse, thereby causing the molecular structure of the flash plugs 15 to heat inductively. The inductive heating serves to heat the plugs 15 to a higher temperature, and may be used either with or instead of the heated gases from the source 14. Cooling water, in the preferred embodiment, is caused to flow through the hollow tubular coil 20 by the pump 22, some or all of the water from the coils being directed by the extension 23*a* to the inlet of the injector 16, so that heated water is supplied to injector 16. The coil 20 receives heat from the heated gasses in the fire chamber 13 and/or from radiation from the plug 15, and the water passing through the coil 20 serves to prevent the tube, which is non-ferrous, from melting, or otherwise being harmfully affected by the heat which is imparted to it.

It will be obvious to those skilled in the art that various changes may be made without departing from the spirit of the invention, and therefore the invention is not limited to what is shown in the drawings and described in the specification buy only as indicated in the appended claims.

I claim:

1. A steam flash plug comprising:

(a) a hollow body member having an open discharge end;

(b) means for injecting a fine spray of water into said hollow body member;

(c) means for inductively heating said hollow body member whereby said fine spray of water is converted into steam when injected into said hollow body member; and (d) a housing defining an expansion chamber having a movable element therein, said expansion chamber having an open end coincident with said hollow body member open discharge end, whereby said expansion chamber physically expands in volume in response to forces which are generated by the steam and applied to said movable element.

2. The flash plug of claim 1 wherein said injecting means includes a nozzle having perforations therein.

3. The flash plug of claim 1 wherein said heating means includes an electrical induction coil disposed adjacent said hollow body member.

4. The flash plug of claim 3 wherein said induction coil is wound around said hollow body member.

5. The flash plug of claim 4 wherein said induction coil is separated from said hollow body member by an electrical insulator.

6. The flash plug of claim 3 wherein said induction coil is hollow for preheating water circulating therethrough.

7. The flash plug of claim 1 further including means for preheating said water being injected into said hollow body member.

8. The flash plug of claim 7 wherein said preheating means includes:

(a) a jacket, defining a fire chamber, surrounding said hollow body member; and (b) a combustion burner cooperating with said fire chamber to pass hot gasses through said fire chamber.

9. The flash plug of claim 8 wherein said preheating means includes a hollow electrical induction coil disposed adjacent said hollow body member.

10. The flash plug of claim 9 wherein said induction coil is separated from said hollow body member by a first electrical insulator and from said jacket by second and third insulators.

11. The flash plug of claim 1 further including a second source of heat for said hollow body member.

12. The flash plug of claim 11 wherein said second source of heat includes:

(a) a jacket, defining a fire chamber, surrounding said hollow body member; and (b) a combustion burner cooperating with said fire chamber to pass hot gasses through said fire chamber.

* * * * *